United States Patent [19]

Karlow

[11] Patent Number: 4,477,789

[45] Date of Patent: Oct. 16, 1984

[54] SOLENOID ARMATURE CUSHION

[75] Inventor: Basil Karlow, Anderson, S.C.

[73] Assignee: The Singer Company, Stamford, Conn.

[21] Appl. No.: 515,827

[22] Filed: Jul. 21, 1983

[51] Int. Cl.[3] ..... H01F 7/08

[52] U.S. Cl. ..... 335/257; 335/248; 335/271; 335/277

[58] Field of Search ..... 335/247, 248, 255, 262, 335/277, 271, 257; 310/30, 24, 34, 35

[56] References Cited

U.S. PATENT DOCUMENTS 985,676 2/1911 Howe .
1,226,748 5/1917 Burnham .
2,619,116 11/1952 Ralston .
2,803,790 8/1957 Andrews ..... 335/257
4,044,324 8/1977 Coors ..... 335/262
4,381,491 4/1983 Vogelyesang ..... 335/277 X

*Primary Examiner*—Donovan F. Duggan
*Attorney, Agent, or Firm*—Daivd L. Davis; Robert E. Smith; Edward L. Bell

[57] ABSTRACT

A cushion element for a solenoid armature is an elongated unitary member formed of a resilient material having a head portion at one end and a tail portion extending therefrom, the tail portion being formed with a protuberance spaced from the head portion. The solenoid stop member is formed with a bore through which the tail portion of the cushion element is inserted, the length of the bore being substantially equal to the distance between the head portion and the protuberance so that the cushion is locked in place by the combination of the head portion and the protuberance.

3 Claims, 2 Drawing Figures

SOLENOID ARMATURE CUSHION

BACKGROUND OF THE INVENTION

This invention relates to solenoids and, more particularly, to a cushion for a solenoid armature.

It is desirable to provide a cushion for the armature, or plunger, of a solenoid to reduce the noise and vibration which would otherwise be generated when the solenoid is energized and the armature impacts on a stop at the end of its travel. Previous cushion designs were unsatisfactory because the cushion did not stay in place. It is therefore an object of this invention to provide a cushion for a solenoid armature which is easily installed and stays in place.

SUMMARY OF THE INVENTION

The foregoing and additional objects are attained in accordance with the principles of this invention by providing a unitary cushion element having a head at one end and an elongated slender tail extending therefrom. The armature stop is provided with a bore along the longitudinal axis of the solenoid. The cushion element tail is adapted to be inserted through the bore from the interior of the solenoid, then pulled therethrough until the head rests against the stop. The tail is further formed with an enlarged region, or protuberance, slightly larger than the bore and spaced from the head a sufficient distance so that when the head abuts the stop inside the solenoid, the protuberance is just outside the solenoid. The cushion is therefore "locked" in place by the combination of the head and the protuberance. After insertion, the tail may be cut past the protuberance.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
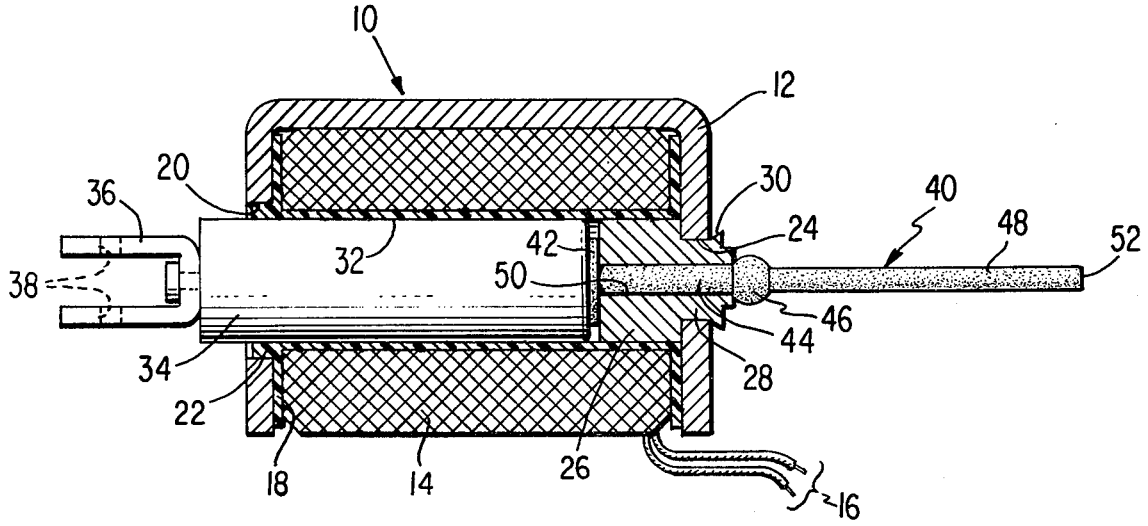
FIG. 1 is a cross-sectional view showing a solenoid having a cushion element constructed in accordance with the principles of this invention.
Figure 2:
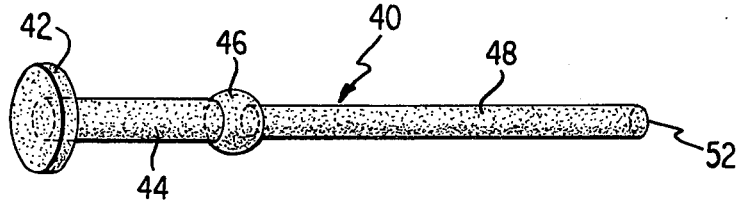
FIG. 2 is an enlarged perspective view of a cushion element constructed in accordance with this invention.

Referring now to the drawings, FIG. 1 shows a solenoid, designated generally by the reference numeral 10, including a ferromagnetic frame member 12, and a coil 14 connected to leads 16 and wound on a plastic bobbin 18, which coil 14 is inserted within the frame member 12 so that when it is energized the frame member 12 provides a return path for the coil flux. The frame member 12 is formed with an opening 20 into which an extension 22 of the bobbin 18 is inserted to hold the coil 14 in place. The frame member 12 is formed with a second opening 24 opposite the opening 20. A stop member 26 is mounted on the frame member 12 by inserting a reduced diameter portion 28 thereof through the opening 24 and then flaring, as at 30, that part of the reduced diameter portion 28 which extends outside the frame member 12. The bobbin 18 is formed with a central opening, or channel, 32 which fits over the stop member 12. Within the channel 32 there is provided an armature, or plunger, 34, which armature 34 is movable within the channel 32 in a longitudinal direction so that when the coil 14 is energized, the armature 34 is drawn inwardly (i.e., to the right as viewed in FIG. 1). A coupling member 36 is attached to the end of the armature 34 which extends outwardly from the solenoid 10. The coupling member 36 is formed with openings 38 to which may be attached whatever linkage is to be controlled by the solenoid 10.

To reduce the noise and vibration which would otherwise be generated when the coil 14 is energized and the armature 34 impacts on the stop member 26 at the end of its travel, there is provided a cushion element, designated generally by the reference numeral 40. The cushion 40 is a unitary element formed of resilient material, illustratively silicone rubber. The cushion 40 is elongated with a head portion 42 at one end and a tail portion 44 extending from the head portion 42. The tail portion 44 is formed with an enlarged region, or protuberance, 46 spaced from the head portion 42. A part 48 of the tail portion extends beyond the protuberance 46. Preferably, the portion 48 is smaller, in cross-section, than the portion 44.

The stop member 26 is formed with a bore 50 in the direction of travel of the armature 34. The bore 50 is smaller than both the head portion 42 and the protuberance 46 of the cushion 40, but is larger than the tail portions 44 and 48. The distance between the head portion 42 and the protuberance 46 is substantially equal to the length of the bore 50. The total length of the cushion 40 is sufficient to enable the end 52 which is remote from the head portion 42 to extend into the bore 50 when the head portion 42 is outside the channel 32. Thus, to install the cushion 40, the head portion 42 is grasped and the end 52 is inserted through the channel 32 into the bore 50. Since the portion 48 is smaller in cross-section than the bore 50, it easily passes through the bore 50, to the right as viewed in FIG. 1, and after it exits the bore 50 it is grasped and the entire cushion 40 is pulled toward the right. Since the cushion 40 is formed of a resilient material, the protuberance 46 compresses sufficiently to pass through the bore 50. When the protuberance 46 is entirely outside the bore 50 and the head portion 42 rests against the stop member 26, the cushion 40 is "locked" in place by the combination of the head portion 42 and the protuberance 46. After installation, the tail portion 48 may be cut off at any point past the protuberance 46.

Accordingly, there has been disclosed an improved cushion for a solenoid armature. It is understood that the above-described embodiment is merely illustrative of the application of the principles of this invention, and it is only intended that this invention be limited by the scope of the appended claims.

I claim:

1. In combination with a solenoid having a coil, an armature movable within a channel with respect to said coil, and a stop for limiting movement of said armature at one end of its travel, the improvement comprising means for cushioning the impact of said armature against said stop including a unitary cushion element formed of resilient material, said cushion element being elongated with a head portion at one end and a tail portion extending from said head portion, said tail portion being formed with an enlarged region spaced from said head portion, said stop being formed with a bore therethrough in the direction of travel of said armature, said head portion and said enlarged region being larger than said bore, the distance between said head portion and said enlarged region being substantially equal to the length of said bore, and the tail portion other than said enlarged region being smaller than said bore.

2. The improvement according to claim 1 wherein said tail portion extends beyond said enlarged region and the total length of said tail portion is sufficient to enable the end of said tail portion remote from said head portion to extend into said bore when head portion is outside said channel.

3. The improvement according to claim 2 wherein the part of the tail portion extending beyond said enlarged region is smaller than the part of the tail portion between the head portion and the enlarged region.

* * * * *